US007416312B1

(12) United States Patent
McDermott

(10) Patent No.: US 7,416,312 B1
(45) Date of Patent: Aug. 26, 2008

(54) MULTI-COLOR LIGHT

(76) Inventor: Kevin McDermott, 110 Oyster Pl., Rockledge, FL (US) 32955

( * ) Notice: Subject to any disclaimer, the term of this patent is extended or adjusted under 35 U.S.C. 154(b) by 0 days.

(21) Appl. No.: 11/544,080

(22) Filed: Oct. 7, 2006

(51) Int. Cl.
*F21V 5/00* (2006.01)

(52) U.S. Cl. ..... 362/216; 362/800; 362/244; 362/249

(58) Field of Classification Search ..... 362/216, 362/235, 238, 240, 244, 249, 326, 335, 800
See application file for complete search history.

(56) References Cited

U.S. PATENT DOCUMENTS 4,677,533 A 6/1987 McDermott
5,224,733 A 7/1993 Simsic
5,577,832 A * 11/1996 Lodhie ..... 362/249
5,899,557 A * 5/1999 McDermott ..... 362/244
6,048,083 A 4/2000 McDermott
6,905,228 B1 * 6/2005 Takeyasu et al. ..... 362/249

* cited by examiner

*Primary Examiner*—Laura Tso

(57) ABSTRACT

A multi-color lighting device 30 capable of emitting light of at least two colors. A group 9 of LED lamps comprising a variety of colors each color having a plurality of LED lamps disposed in an equiangular array. The color of the emitted light selected by a circuit having a schematic 16 and a switch 6, which selectively energizes lamps of the desired color. Each color of emitted light is refracted by a light converging lens 1 which surrounds group 9 of LED lamps and concentrates the light emitted by the energized lamps to intensify the light emitted by the lighting device toward an elongated output beam having a specification vertical beam width smaller than a specification azimuth. Switch 6 selectively energizes each plurality of lamps representing each color within the group to an established and usually substantially fixed power level. The established power level for each color is established as adequate when light emitted from the lighting device of that color meets a required photometric specification.

34 Claims, 7 Drawing Sheets

FIG 16
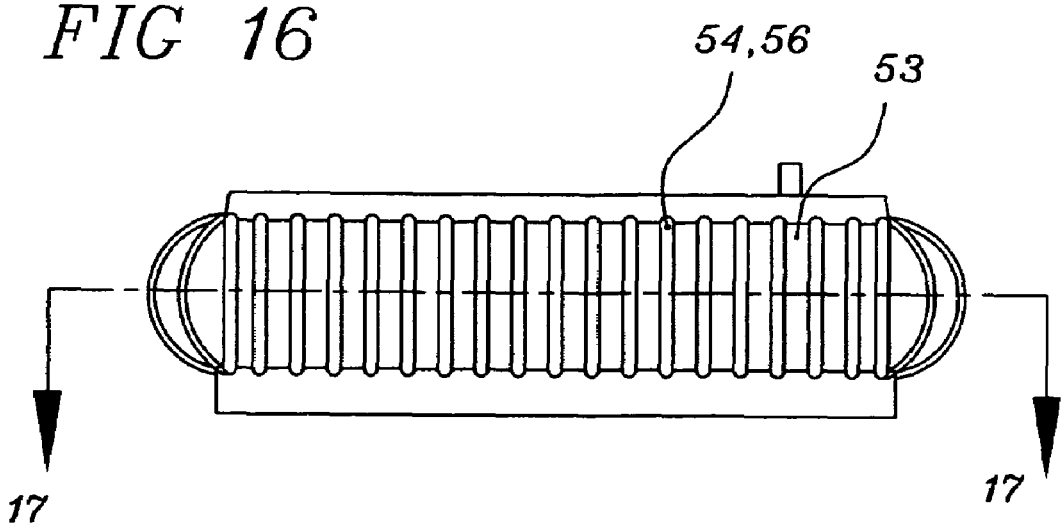
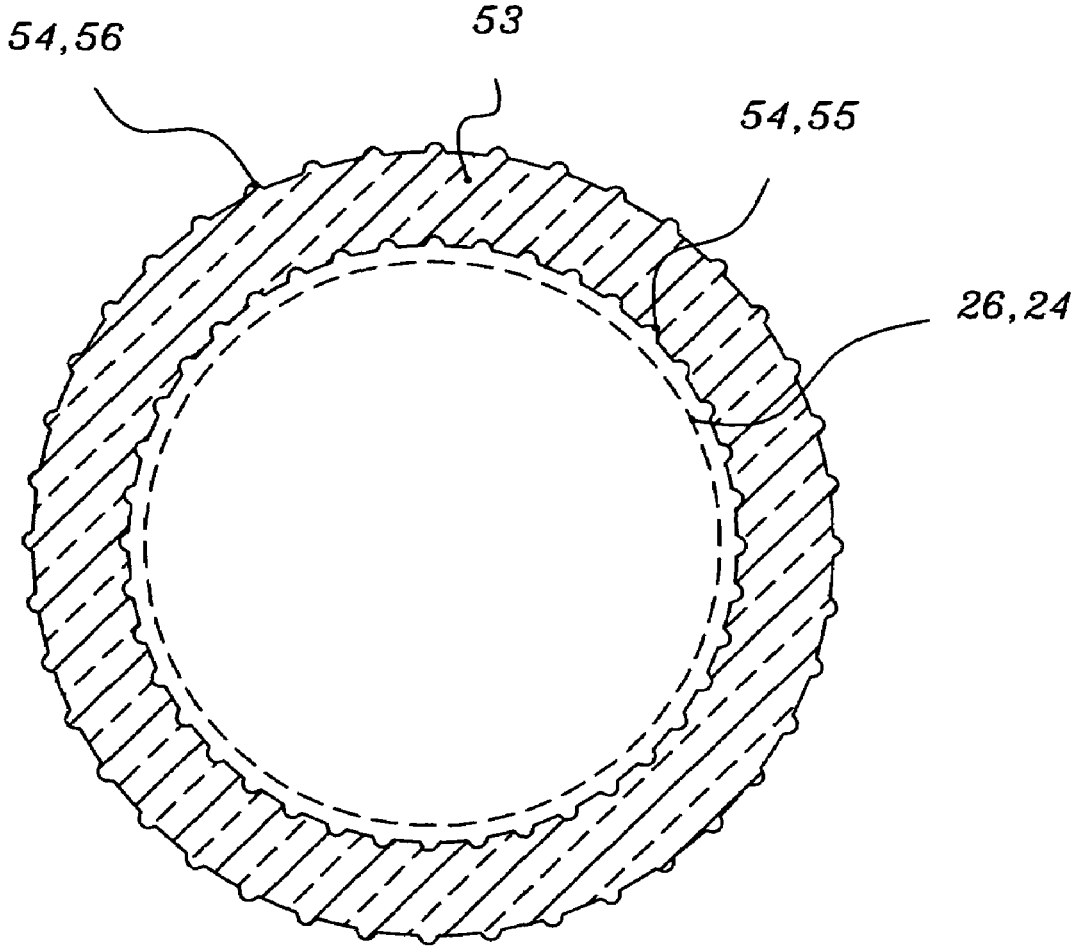
FIG 17

MULTI-COLOR LIGHT

BACKGROUND OF THE INVENTION

1. Field of Invention

This invention relates to a multi-color lighting device which employs a group of LED lamps to emit a selectable variety of colors of light. The light is then concentrated by a converging cylindrical lens towards an elongated light beam having a specification azimuth and specification vertical beam width.

2. Prior Art

Typical prior art for a lighting device emitting light having a large azimuthal and small vertical beam width can be found in U.S. Pat. No. 5,224,733 issued to Arimura in which a circular array of a large number of LED lamps direct their diverging light into a linear fresnel lens to create a horizontal light beam throughout the azimuth. Arimura in column 5 lines 49-55 describes a focal circle having a one-inch diameter and eighty LEDs arranged in an array. This array is encircled by a thin linear fresnel lens. The Arimura design only employs a single color. However, even with the single color a quantity of LEDs are employed to approach a uniform intensity throughout the emerging beam.

U.S. Pat. No. 6,048,083 issued to McDermott employs classical lenses in place of the thin fresnel lens of Arimura to concentrate the light from his array of LED lamps. McDermott places the focal point of his LED lamps between the bent focal point of the lens and the interior wall of the lens in order to maximize the efficiency for light concentrated towards the horizontal.

U.S. Pat. No. 5,899,557 issued to McDermott disclosed employing a radial array of LED lamps of a single color encircled by a curved cylindrical surface to concentrate the emitted light into an output beam with a vertical beam width and a large azimuthal beam width. A hollow within the lens is not required in this prior art.

U.S. Pat. No. 4,677,533 issued to McDermott employs a multi-color LED lighting device with a flat lens. There is no curved focal line. There is a circuit FIG. 7 with LED lamps of a variety of colors but no switch for selecting one color and no power control for assuring an established energy level.

Prior art did not provide arrays with curved focal lines and multi-color capability. The above three prior art designs with curved focal lines only disclose a single color. In the current application a multiplicity of output beams each of a different color are required. This requirement of multi-color output presents serious problems for prior art. These problems increase as the uniformity, intensity and beam width of the output beam in each color are required to comply with more difficult specifications. If there are photometric specifications to be met, it is often easy for a lighting device design to comply with a specification when only one color is required and not comply when multiple colors are required. A single color lighting device may have an acceptably uniform and intense emitted beam with each of its LED lamps in a radial array disposed according to prior art. Adding a second plurality of LED lamps of a second color into this array seriously degrades the prior art design resulting in an output beam that will no longer be uniform or of adequate intensity.

Prior art discloses LED lamps in tactile arrays. Most specifications establish minimum intensity requirements within a vertical and azimuthal beam spread. Therefore, lighting devices which emit non-uniform light beams require excessive power as the overall intensity of the emitted beam must be increased in order for all portions of the light beam to meet the minimum requirements. All three of the above prior art patents address this issue by using a plurality of LED lamps placed in a tight array about the center of the lens. Thus, each LED lamp is as close to the geometrical center as possible within the limitation that there are a plurality of lamps in the array. McDermott in U.S. Pat. No. 6,048,083 FIG. 8, Column 12, Lines 37-67 and Column 13, Lines 1-14 discloses his objective to position the LED lamps in a tight array in order to emit light concentrated about the horizontal with minimum loss (divergence) of light.

McDermott in FIGS. 6 and 8, Column 9, Lines 16-25 and Column 13, Lines 7-14 discloses LED types including a spherical body and a wedge base which could be employed to reduce the separation distance between LED lamps. All of referenced prior art disclosed devices using a tight array concept. Unfortunately, this concept cannot be applied if the same array is required to provide multiple colors. All three of the referenced prior art patents would have had a problem providing a lighting device efficiently creating a uniform output beam and additionally of selectively emitting multiple colors. A requirement to emit multiple colors would result in LED arrays with large angular gaps between the LEDs representing each color. If, for instance, Arimura in FIG. 2, Column 5, Lines 50-55 were to require five colors, his array of 80 LEDS would include only 16 LEDs of each color. If the 16 LEDs of one of the selectable colors were lit, then these lit LEDs would not represent the tight array of light emitting LED lamps shown by Arimura. They would in fact have large gaps of unlit LEDs of other colors occupying the space between the emitting LED lamps. Further, each lit LED would be straddled by unlit LED lamps and the bodies of these unlit lamps would intercept and misdirect emitted light as it passes through them. This vast reduction in the number of LEDs of the original color envisioned by Arimura would reduce his light's intensity substantially. In addition, his emitted light beam would become a light beam of greatly varying intensity including hot spots and dim zones. This intensity variation would be problematic in meeting many specifications and lower the efficiency of the device.

Prior art implies using a large focal length relative to the size or outside diameter of the lens and discloses problems relating to the shape of the LED lamp that is used. In McDermott U.S. Pat. No. 5,899,557 Column 10, Lines 57-59, he discloses the objective of increasing distance D2. This is equivalent to increasing the focal length.

In McDermott U.S. Pat. No. 6,048,083, FIG. 10, Column 13, Lines 34-66, McDermott discloses an apparent focal point problem with the T1 ¾ LED lens top lamps that can cause the lighting device to squander light. Specifically, the body of the T1 ¾ LED normally has a lens that refracts emitted light. This refraction creates a plurality of apparent focal points which causes the LED to appear to the lens as an enlarged light source. McDermott offers a spherical top LED as a preferred way to alleviate this problem. The spherical LED, theoretically, does not refract light emitted from the LED element and therefore, theoretically, does not cause the small LED emitter to appear large. This concept does greatly improve the situation but due to manufacturing variations in the spherical contour and placement of the LED element, does not totally eliminate it. Nevertheless, this type of problem is one reason that prior art places its LED arrays at a substantial focal distance (visually observed from the Figures provided in the referenced prior art) from the lens. In general, in order to control the light more effectively, it is desirable to have both a lens with a large focal distance combined with a very small or a point light source. The large focal distance indicated by prior art of variations in light source placement or lens contour. It also reduces the negative consequences relating enlargement of the light source size related to shifting of the apparent point of emission. Since no light source is as small as a point source and since even small light sources can have apparent size enlargements due to refraction at their lens or body, it is usually desirable to have a large focal length to offset these problems. Unfortunately, the large focal length employed by the referenced prior art for a single color device when combined with an array comprising several pluralities of LED emitters each of differing colors, as disclosed in the current patent application, works against designing a lighting device which is compact, efficient and emitting a light beam with uniform intensity throughout a specification azimuth and vertical beam width.

Prior art does not disclose a circuit or switch designed to selectively provide a different power to different colors to obtain a specification required emerging beam for each color. Prior art energized all of the LED lamps within the array equally. This would not be desirable for most multi-color lighting devices. LED lamps of varying colors can have different efficiencies. They can also have different light emitting element configurations and as discussed herein, respond—due to the specific color—differently to the single common lens. The current invention provides a circuit which can deliver selected power to each of the selectable colors by providing a possibly different power to the plurality of lamps representing each color. The current invention can overcome the differences between colors by applying a different power to each color to assure that the emitted light of each color is adequate to comply with the output beam specification.

The referenced prior art teaches or at least implies the following concepts which are taught against in the current invention:

- positioning each LED lamp of a color within its array in a close or tactile relationship with adjacent LED lamps of the same color and as close to the center of the lens hollow as possible
- having a lens which defines a focal distance which is substantial in magnitude relative to the radius of the LED array The referenced prior art teaches the following concepts which are employed in parts of the current invention:

- a curved cylindrical surface or a fresnel lens which is formed to provide a curved focal line, bent focal line or a plurality of focal points to provide an emerging elongated light beam having a vertical beam width and a larger azimuth.
- a curved array of LED lamps with each lamp having its LED element or the apparent point of emission at the related focal point
- a curved array of LED lamps with each lamp having its LED element or the apparent point of emission between its related focal point and the lens The referenced prior art does not teach or address the following concepts which are employed in the current invention:

- an array or group of LED lamps having a variety of colors each of which includes a plurality of LED lamps
- a circuit and switching means capable of selectively energizing each plurality of colors of LED lamps with a dedicated established power level such that emitted light of each color is adequate to comply with a governing specification requirement without excessive power consumption.
- a single converging lens disposed and contoured for concentrating light from a plurality of colored LED lamps
- an array of ceramic LED lamps each of which comprise a ceramic body capable of withstanding high heat and each being attached to the peripheral edge of a printed circuit board to disperse that heat
- disposing a circle of LED lamps each with their apparent point of emission between a plurality of color related focal lines and the lens
- a light converging lens having a small back focal length employed to reduce the variations in the focal length and focal circle resulting from color related changes in the index of refraction of the lens.
- using ceramic LED lamps without lenses so that a variety of colors will not result in a color related variation in the shifting of the apparent point of light emission within each LED due to its lens. Avoiding color related shifting within each LED resulting from a lens on the LED permits a group of LEDs to be mounted on a circular apparent point of emission line. If the LEDs have lenses or even domes then their apparent point of emission can shift and this shifting will vary in magnitude because it is color related. If LEDs within a color related variation in shifting are then mounted on a circle the surrounding lens will see the emitted light from each LED of a different color at a different location even though all of the LED lamps are physically equal and mounted on a common circle. This variety of apparent points of emission seen by the lens creates misdirected light.
- Improving the efficiency while maintaining compliance with some specifications by having a lens with a short focal length in place of the long focal length of prior art.
- Improving the efficiency while maintaining compliance with some specifications by having a lens with a short focal length combined with LED lamps devoid of a lens.

OBJECTS AND ADVANTAGES

The objects and advantages of the present invention are to create a multi-color lighting device employing a single lens to concentrate light of a variety of colors into a plurality of elongated light beams each having a substantially uniform intensity; and a) to provide an efficient lighting device capable of emitting a powerful and substantially uniform elongated light beam of each color of a plurality of selectable colors;

b) to provide a compact lighting device capable of emitting a powerful and substantially uniform elongated light beam with a means to change the color of that light beam;

c) to provide an LED lighting device which minimizes the operating temperature of its LED lamps thereby increasing their efficiency;

d) to provide a lighting device which emits elongated light beams of a plurality of selectable colors through a single optic wherein the emitted light beams are substantially congruent. This feature helps assure that the light is visible to observers positioned within the specification beam width regardless of the color being emitted;

e) to provide a lighting device which emits elongated light beams of a plurality of selectable colors each of which emerge from the same common lens. This feature helps reduce confusion for nearby observers as the light will not appear to jump as colors are changed;

f) to provide a lighting device which emits light beams of a plurality of selectable colors wherein a circuit included with the lighting device provides adequate established and possibly different power to each plurality of LEDs of each selected color such that no energy is wasted in meeting the specification requirements for each color;

and to provide a compact light that is capable of selectively emitting light of a plurality of colors and which can be employed in locations having dimensional or weight limitations.

Further objects and advantages are realized through combinations of the above distinct advantages.

SUMMARY

In accordance with the present invention a lighting device comprises a converging lens for concentrating light into an elongated light beam; said lens having a curved contour, a hollow and a plurality of focal points; a group of LED lamps positioned within said hollow to direct emitted light radially outward to intersect said converging lens; a circuit comprising said group of LED lamps and a switch for selectively connecting each said plurality of LED lamps to a power supply to energize them to an established energy level; said light concentrated by said lens into an elongated beam.

DRAWINGS

Figures

FIG. 1 is a perspective view of the preferred embodiment of lighting device 30

FIG. 2 is a front view of FIG. 1

FIG. 3 is an enlarged cross-section taken along line 3-3 of FIG. 2

FIG. 4 is an enlarged cross-section taken along line 4-4 of FIG. 3

FIG. 5 is an enlarged view of printed circuit board assembly 2 removed from FIG. 4

FIG. 6 is a perspective view of typical red LED R1 removed from FIG. 4

FIG. 7 is a rear view of red LED R1 of FIG. 5

FIG. 8 is a schematic of the circuit configured on the printed circuit board of FIG. 5

FIG. 9 is a view of lens 1 removed from FIG. 3

FIG. 10 is a view of lens 1 removed from FIG. 4

FIG. 11 is an enlarged view of the portion of FIG. 3 around red LED R1

FIG. 12 is an enlarged view of the portion of FIG. 4 around red LED R1

FIG. 13 is a front view of lighting device 34 an alternate configuration of FIG. 1 lighting device 30 employing a fresnel lens FIG. 14 is a cross sectional view taken across line 14-14 of FIG. 13

FIG. 15 is an enlarged diagrammatic view of a prior art LED lamp

FIG. 16 is a front view of converging lens 53 an alternate configuration of converging lens 1 of FIG. 1

FIG. 17 is a cross sectional view of converging lens 53 taken along line 17-17 of FIG. 16

DRAWINGS - Reference Letters

| | |
|---|---|
| B1 thru B8 | Blue LED Lamps |
| G1 thru G8 | Green LED Lamps |
| R1 thru R8 | Red LED Lamps |
| W1 thru W8 | White LED Lamps |
| Y1 thru Y8 | Infrared LED Lamps |
| A1 | Vertical Included Angle |
| A2 | Horizontal Included Angle |
| C1 | Red Resistor |

-continued

| | |
|---|---|
| C2 | Green Resistor |
| C3 | Blue Resistor |
| C4 | White Resistor |
| C5 | Infrared Resistor |
| D1 | Back Focal Length |
| D2 | Vertical Distance |
| D3 | Horizontal Distance |
| F1 | Focal Point |
| H | Horizontal Plane |
| L1 | Upper Vertical Light Ray |
| L2 | Lower Vertical Light Ray |
| L3 | Left Horizontal Light Ray |
| L4 | Right Horizontal Light Ray |
| L5 | Left Horizontal Green Light Ray |
| P1 | Upper Intersection Point |
| P2 | Lower Intersection Point |
| P3 | Left Intersection Point |
| P4 | Right Intersection Point |
| P5 | Green Intersection Point |
| S1 | Red Circuit |
| S2 | Green Circuit |
| S3 | Blue Circuit |
| S4 | White Circuit |
| S5 | Yellow Circuit |
| V | Vertical Plane |

DRAWINGS - Reference Numerals

| | |
|---|---|
| 1 | converging lens |
| 2 | printed circuit board assembly |
| 3 | screw |
| 4 | hole |
| 5 | printed circuit board |
| 6 | switch |
| 7 | power supply |
| 8 | tracks |
| 9 | group |
| 10 | |
| 11 | hollow |
| 12 | negative solder pad |
| 13 | positive solder pad |
| 14 | ceramic body |
| 15 | light emitting element |
| 16 | schematic |
| 17 | lens hole |
| 18 | peripheral bottom |
| 19 | peripheral top |
| 20 | peripheral edge |
| 21 | knob |
| 22 | contact arm |
| 23 | lens hole |
| 24 | focal circle |
| 25 | focal points |
| 26 | focal line |
| 27 | interior surface |
| 28 | curved exterior surface |
| 29 | plano convex form |
| 30 | lighting device |
| 31 | center point |
| 32 | alternate point |
| 33 | apparent emission line |
| 34 | lighting device |
| 35 | fresnel lens |
| 36 | printed circuit board assembly |
| 37 | |
| 38 | |
| 39 | |
| 40 | lamp |
| 41 | body |
| 42 | axis |
| 43 | element |
| 44 | lens |
| 45 | light ray |
| 46 | point of intersection |
| 47 | angle |
| 48 | normal |
| 49 | angle |
| 50 | apparent point of emission |
| 51 | distance |

-continued

| | |
|---|---|
| 52 | |
| 53 | converging lens |
| 54 | light spreading elements |
| 55 | grooves |
| 56 | ribs |

DESCRIPTION OF THE DRAWINGS

FIG. 1 is a perspective view of lighting device 30. FIG. 2 is a front view of lighting device 30. FIG. 3 is a cross-section along lines 3-3 of FIG. 2. FIG. 4 is a stepped cross-section taken across line 4-4 of FIG. 3. FIG. 3 includes lens 1 and printed circuit board assembly 2 connected and fastened together with screw 3 inside of lens hollow 11. FIG. 5 shows printed circuit board assembly 2 removed from FIG. 4. Printed circuit board assembly 2 includes printed circuit board 5, five position rotary switch 6, power supply 7 and group 2 of rectangular ceramic LED lamps. Printed circuit board 5 comprises conductive tracks 8 and hole 4 for accepting screw 3.

FIGS. 6 and 7 are perspective and rear views of typical ceramic red LED R1, Model NFSR036CT made by Nichia Corp. Equivalent ceramic LED lamps are available from other manufacturers. Red LED R1 is typical (except for color variations) of the forty LED lamps of group 9. Red LED R1 comprises negative solder pad 12, positive solder pad 13, ceramic body 14 and light emitting element 15.

FIG. 8 is a schematic 16 of the circuit on printed circuit board assembly 2 of FIG. 5. Printed circuit board 5 is manufactured with conducting tracks 8 and assembled using classical methods so that printed circuit board assembly 2 comprises circuit schematic 16 of FIG. 8. A large number of conductive tracks 8 are required to effect the required circuit. However, for simplicity of illustration, only several are drawn in FIG. 5. Power supply 7 and switch 6 are attached to printed circuit board 5 using classical methods such as solder tabs. In FIG. 5 group 9 is comprised of forty LED lamps having an equiangular spacing at nine degree intervals. The forty LED lamps include a plurality of eight red LED lamps R1 through R8 having an equiangular spacing at forty-five degree intervals, a plurality of eight green LED lamps G1 thru G8 having an equiangular spacing at forty-five degree intervals, a plurality of eight blue LED lamps B1 through B8 having an equiangular spacing at forty-five degree intervals, a plurality of eight white LED lamps W1 through W8 having an equiangular spacing at forty-five degree intervals and a plurality of eight infrared LED lamps Y1 through Y8 having an equiangular spacing at forty-five degree intervals. Therefore, when viewing FIG. 5 and proceeding in a clockwise rotation, the group 9 LED lamps form a repeating pattern of red, green, blue, white and infrared LED lamps. Therefore, group 9 comprises a variety of colored LED lamps with a plurality of LED lamps representing each color. Each LED of group 9 is soldered using its negative solder pad 12 and positive solder pad 13 to peripheral bottom 18 and peripheral top 19 of printed circuit board 5 at peripheral edge 20 by means of conducting tracks 8. Conducting tracks 8 additionally connect power supply 7 and switch 6 to form an electrical circuit as shown in schematic 16 of FIG. 8. In FIG. 8 power supply 7 is in an electrical series circuit with rotary switch 6. Rotary switch 6 can be adjusted with knob 21 which passes through lens hole 17 in lens 1. Red circuit S1 comprises eight red LED lamps R1 through R8 in series with red resistor C1, green circuit S2 comprises eight green LED lamps G1 through G8 in series with green resistor C2, blue circuit S3 comprises eight blue LED lamps B1 through B8 in series with blue resistor C3, white circuit S4 comprises eight white LED lamps W1 through W8 in series with white resistor C4 and infrared circuit S5 comprises a plurality of eight infrared LED lamps Y1 through Y8 in series with infrared resistor C5. Rotary switch 6 is shown with contact arm 22 energizing red circuit S1. Contact arm 22 of rotary switch 6 can be rotated with knob 21 to selectively energize any one of circuits S1 through S5.

FIG. 9 is lens 1 removed from FIG. 3. FIG. 10 is lens 1 removed from FIG. 4. Looking at FIGS. 3, 4, 9 and 10 lens 1 is a classical light converging lens having interior surface 27 and curved exterior surface 28. In FIG. 9 lens 1 has a vertical cross-section which is a plano convex form 29 having focal point F1. Plano convex form 29 is rotated about center point 31 of lens 1 to effect a curved cylindrical contour. Lens 1 is thereby contoured to define a plurality of focal points 25 in horizontal plane H along the locus of which is a first curved line curved focal line 26. In the present embodiment, curved focal line 26 is substantially horizontal and is a focal circle 24.

Figure 1:
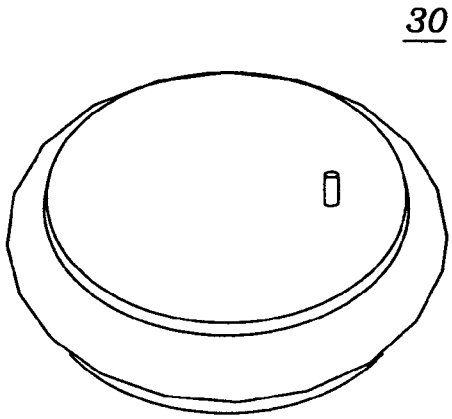
FIGS. 1 through 12 show the preferred embodiment of the present invention.
Figure 2:
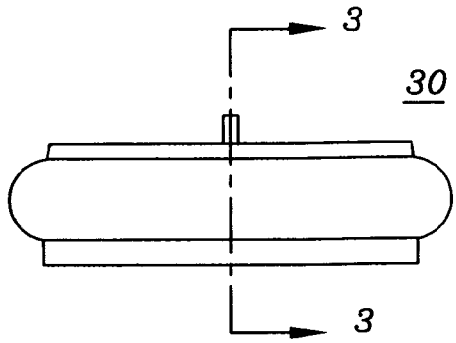

Each LED of group 9 of LED lamps is disposed on focal circle 24 in a circular radial array with its LED element directed radially outward from center point 31 of focal line 26 towards interior surface 27 of lens 1 to thereby direct its emitted light to intersect lens 1. Center point 31 is the center point of hollow 11 and lens 1.

Figure 3:
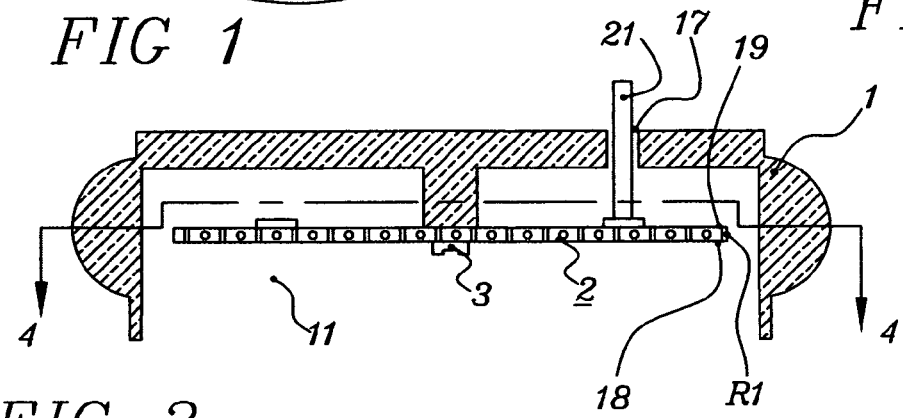
Figure 4:
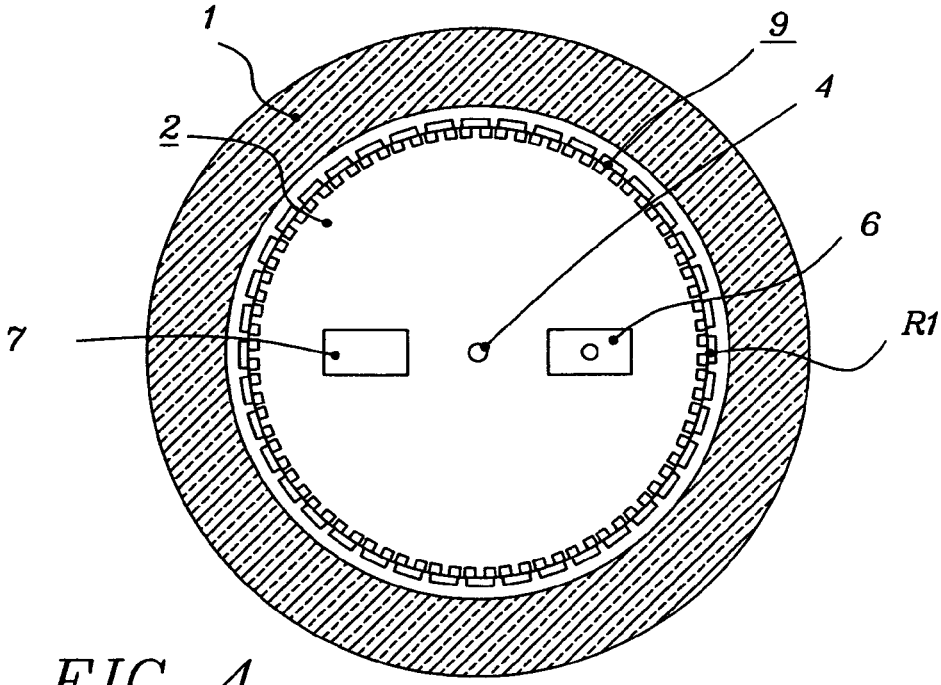
Figure 5:
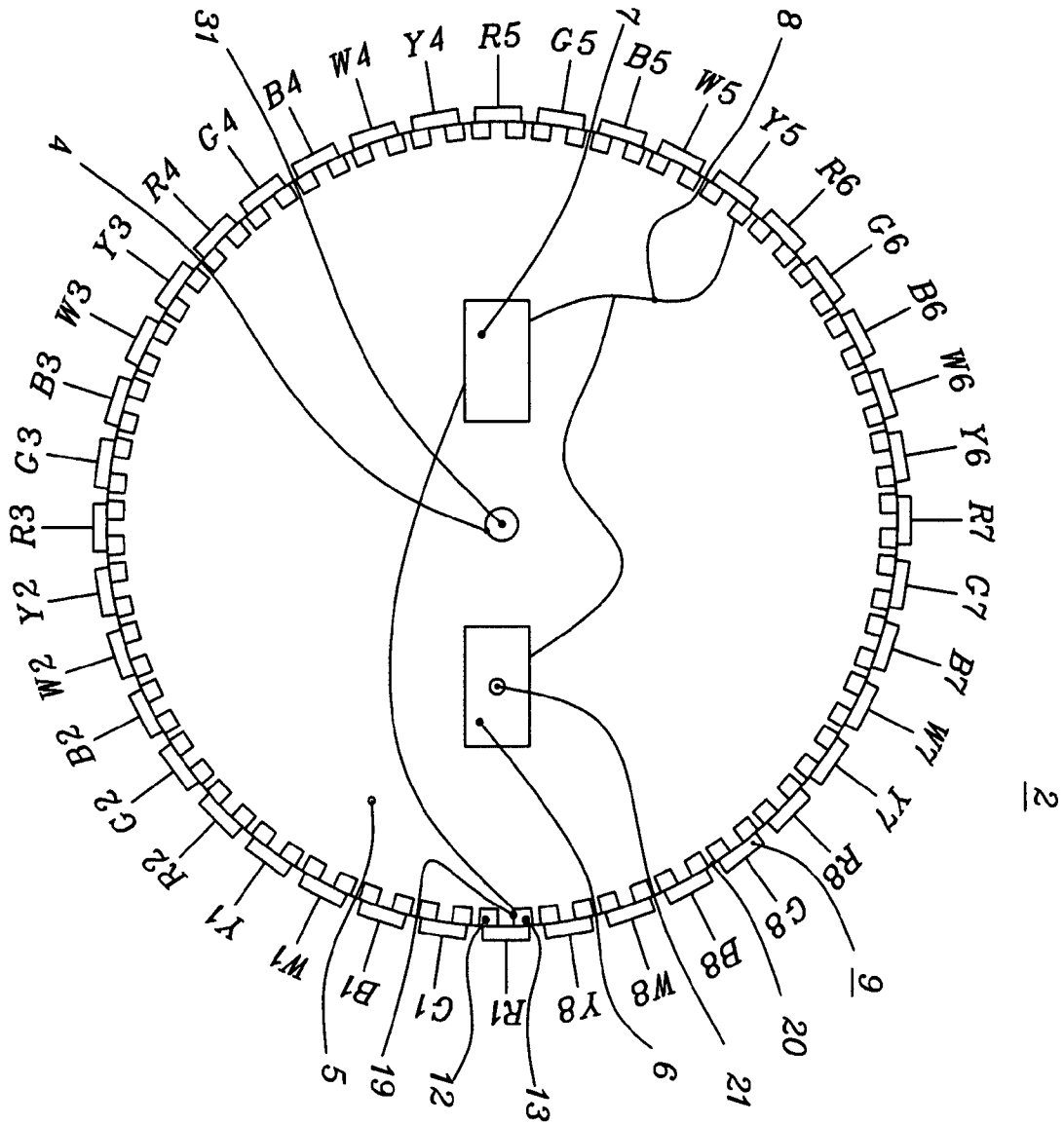
Figure 6:
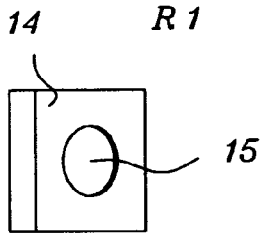
Figure 7:
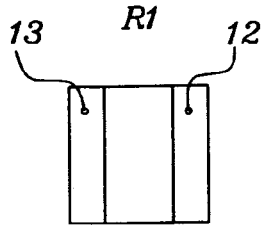
Figure 9:
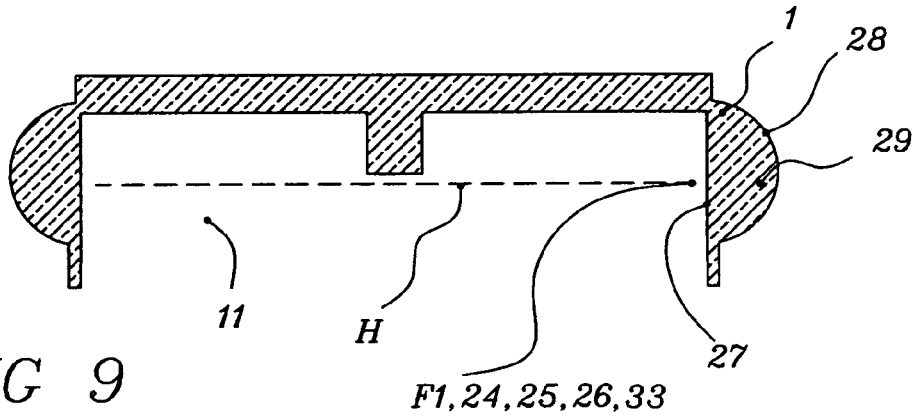
Figure 10:
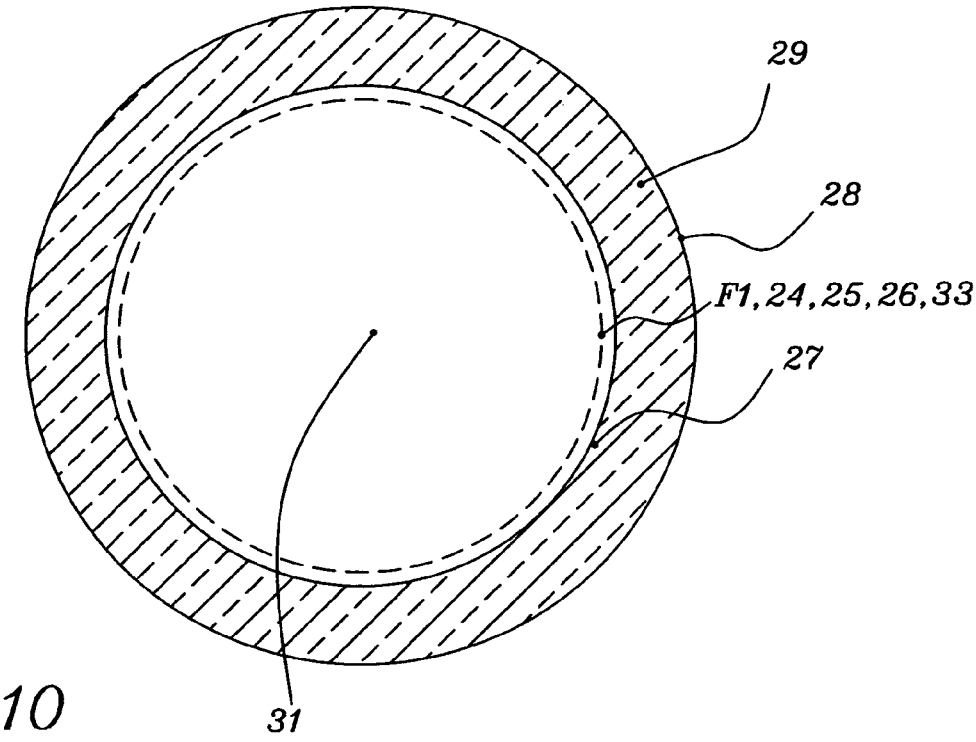
Figure 11:
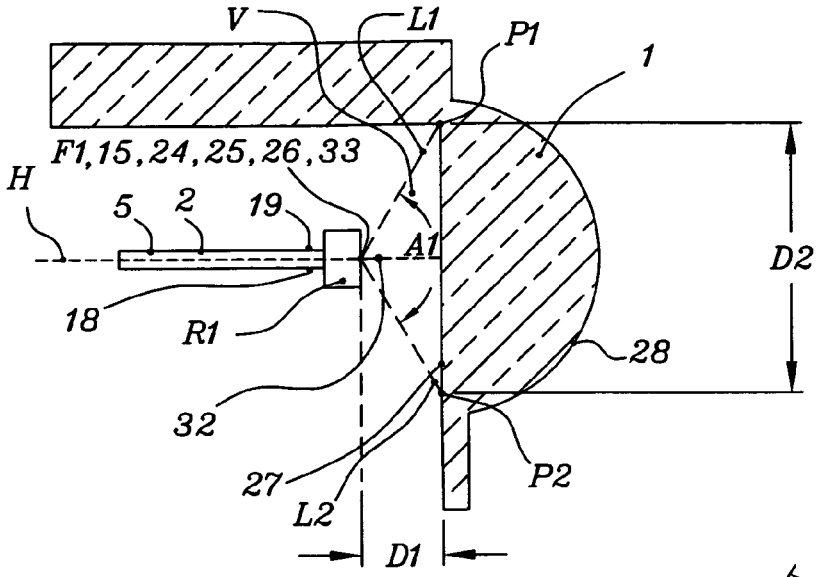
Figure 12:
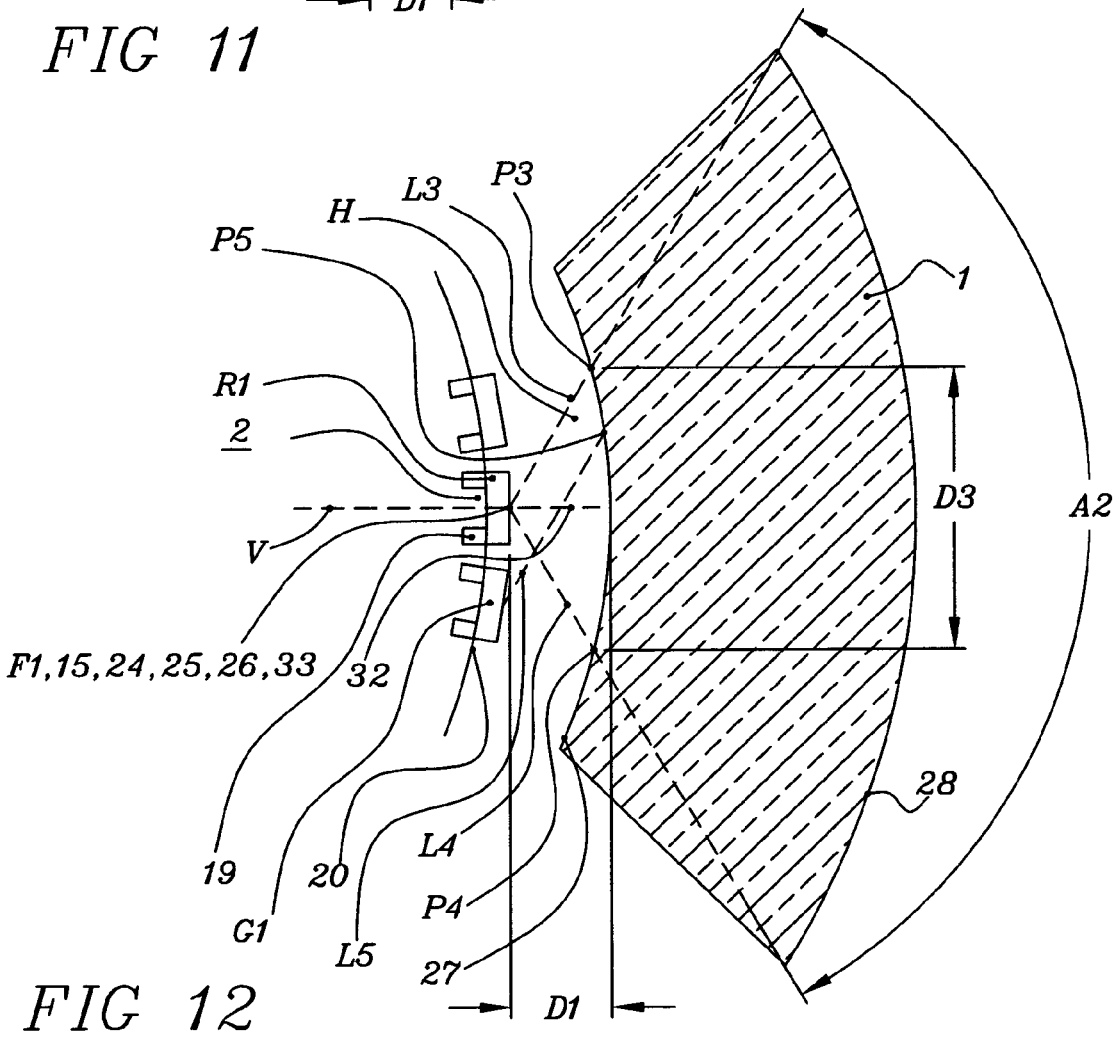

FIG. 11 is an enlarged diagrammatic view of the portion of FIG. 3 around red LED R1. FIG. 12 is an enlarged diagrammatic view of the portion of FIG. 4 around red LED R1. In FIGS. 9 and 11 back focal length D1 of lens 1 is 5 millimeters and represents the distance between interior surface 27 and focal point F1 of focal line 26 of lens 1 at red LED R1. Printed circuit board assembly 2 is disposed so that group 9 of LED lamps is positioned with the light emitting element of each of its forty LED lamps—typified by light emitting element 15 of red LED R1—on apparent emission line 33 with their emitted light directed radially outward from center point 31 at curved interior surface 27. Apparent emission line 33 is a curved line passing through the apparent point of emission for each LED lamp. In the present embodiment the LED lamps which are employed each have their apparent point of emission at their light emitting element and therefore, apparent emission line 33 is congruent with focal circle 24. Alternate specifications may make it beneficial to place apparent emission line 33 between focal circle 24 and lens 1. This issue will be discussed later.

FIG. 11 shows red LED R1 emitting upper vertical light ray L1 in vertical plane V at 60 degrees above horizontal plane H and lower vertical light ray L2 at 60 degrees below horizontal plane H forming vertical included angle A1. Light rays L1 and L2 intersect curved interior surface 27 of lens 1 at upper point P1 and lower point P2 respectively which are separated by vertical distance D2. Vertical distance D2 represents the height of lens 1 required to intersect emitted light within vertical included angle A1. FIG. 12 is an enlarged diagrammatic view of the portion of FIG. 4 around red LED R1. FIG. 12 shows red LED R1 emitting left horizontal light ray L3 in horizontal plane H at 60 degrees to the left of vertical plane V and right horizontal light ray L4 in horizontal plane H at 60 degrees to the right of vertical plane V forming horizontal included angle A2 also of 120 degrees. Left horizontal light ray L1 and right horizontal light ray L4 intersect lens 1 at left intersection point P3 and right intersection point P4 respectively separated by horizontal distance D3. Left horizontal light ray L3 intersects interior surface 27 at left intersection point P3. Green LED G1 disposed alongside red LED R1 when energized by switch 6 emits a diverging light including left horizontal green light ray L5 in horizontal plane H at sixty-degrees to the left of vertical plane V which intersects interior surface 27 at green intersection point P5. Green intersection point P5 is between left intersection point P3 and right intersection point P4. Therefore, green LED G1 and red LED R1 use a common portion of lens 1 to concentrate their emitted light. Some of the remaining LED lamps also can use the same common area of lens 1 depending upon a number of parameters including but not limited to the number of LED lamps in group 9 of LED lamps and focal distance F1. Alternate point 32 is to be discussed later.

Figure 13:
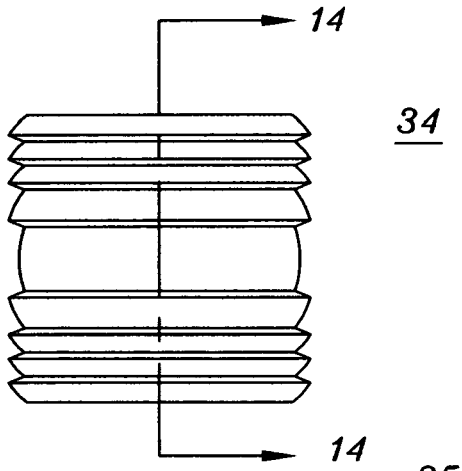
Figure 14:
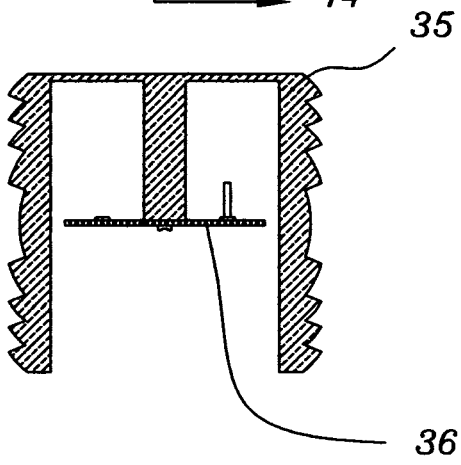

FIGS. 13 and 14 disclose lighting device 34 similar to lighting device 30 of FIG. 1. FIG. 13 is a front view of lighting device 34 and FIG. 14 is a cross sectional view of taken across line 14-14 of FIG. 13. In FIGS. 13 and 14 fresnel lens 35 is substituted for converging lens 1 of FIG. 1 and printed circuit board assembly 36 is identical to printed circuit board assembly 2. Fresnel lighting device 34 represents a classical substitution of a fresnel lens for converging lens 1 of lighting device 30.

Figure 15:
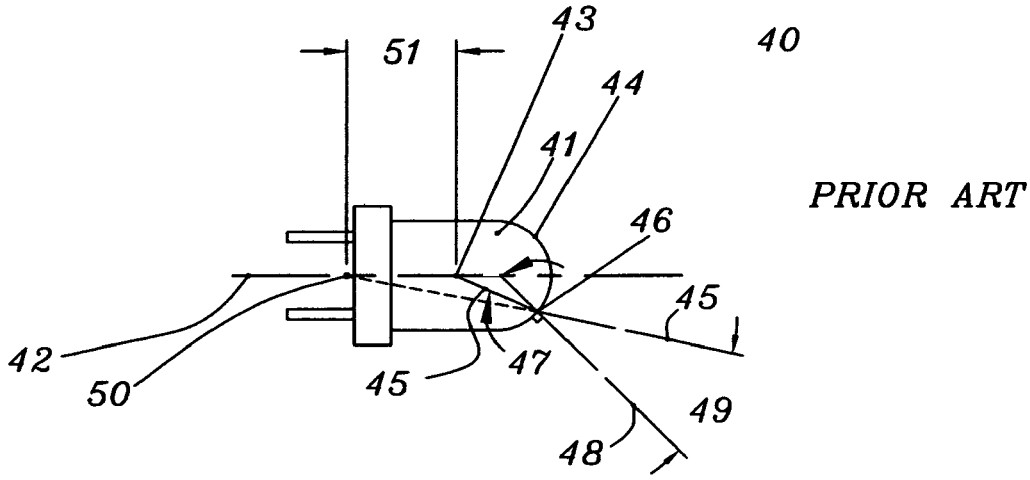

FIG. 15 is an illustrative side view of a typical prior art T1 ¾ LED lamp 40 with a lens incorporated into its body. LED lamp 40 is typical commercial T1 ¾ LED lamp. LED lamp 40 includes body 41, geometric body axis 42 and LED element 43. Body 41 includes light converging lens 44 designed to refract light rays leaving body 41 such that they emerge from LED lamp 40 more parallel to geometric axis 42 then when emitted from LED element 43. Typical light ray 45 emitted from LED element 43 towards lens 44 intersects lens 44 at point of intersection 46 and forms included angle 47 with normal 48 to lens 44 at point of intersection 46. According to the basic laws of optics light ray 45 is refracted to emerge from lens 44 forming included angle 49 with normal 48. Due to the refraction at lens 44 refracted emerging light ray 45 is more parallel to geometric body axis 42. If refracted light ray 45 is projected back into LED lamp 40 it intersects geometric body axis 42 at apparent point of emission 50. LED lamp 40 has only one actual LED element 43 and therefore only one point of light emission. However, due to lens 44 light ray 45 appears to originate from a location separated from the location of LED element 43. Distance 51 represents the separation between the actual point of emission of light ray 45 at LED element 43 and its apparent point of emission 50. If LED lamp 40 is substituted for red LED lamp R1 in the FIG. 11 embodiment of the current invention, lens 1 will refract light emerging from LED lamp 40 as if it were emerging from apparent point of emission 50 and not from the location of LED element 43. Therefore, in that situation for lens 1 to direct the light from lamp 40 properly, lamp 40 would have to be located relative to focal point F1 of FIG. 11 based upon its apparent point of light emission 50 rather than the actual location of LED element 43. The current invention in using LED lamps such as red LED R1 which do not include integral lenses or optics and which, therefore, have their apparent point of emission at their LED element 15 does not have to adjust the position of each LED element relative to focal point F1 to account for a separation between the actual and the apparent location of its LED element.

FIG. 16 is a front view of converging lens 53 an alternate configuration of converging lens 1 of FIG. 1. FIG. 17 is a cross-section taken across line 17-17 of FIG. 16. Converging lens 52 is similar to converging lens 1 except that light spreading elements 54 comprising vertical grooves 55 have been added to interior surface 27 and vertical ribs 56 have been added to curved exterior surface 28 of lens 1.

OPERATIONAL DESCRIPTION OF THE PREFERRED EMBODIMENT FIGS. 1-12

Lighting device 30 of FIGS. 1 through 12 is the preferred embodiment of the present invention. Lighting device 30 is a device in which the user can selectively choose to emit light of any one of five colors with each color being intensified and emitted through a single lens. A typical required photometric specification for a lighting device typified by lighting device 30 would include a substantially uniform output beam having a minimum intensity throughout a vertical beam width of four degrees from minus two degrees to plus two degrees throughout a three hundred and sixty degree azimuth. There are a large number of user defined required specifications. Two common specifications require vertical beam widths of ten and thirteen degrees respectively with a three hundred and sixty degree azimuth. Therefore, the required photometric specification including the vertical beam width and required azimuth can vary. In order to comply with a particular specification, adjustments in design parameters of lighting device 30 such as the contour of lens 1, number of LED lamps, positioning of LED lamps, power supplied, etc would be required. These adjustments can be made by a person experienced in the art using classical concepts and by trial and error.

Prior art encouraged a relatively large focal length because it—as previously described—solved many problems. A small focal length also had advantages such as a reduction in both the mass of lens 1 and the overall size of the lighting device. However when prior art considered the issue, the large focal length was the best choice. Two factors that were included when making that decision were enlargement of the apparent point of emission resulting from the limited number of commercially available LEDs and the requirement to have an emerging light beam that had minimal divergence about the horizontal. In the current invention ceramic LED lamps virtually eliminated enlargement and shifting of the apparent point of emission. Also, in the current invention the emerging light is no longer required to be concentrated with minimal divergence about the horizontal. The current invention takes into account that many specifications require the light to be concentrated within a beam width. This beam width can extend from four to fifty degrees. The elimination of the apparent shifting and the new wide beam width objectives individually and in combination make embodiments of lighting device 30 having small focal lengths more desirable. In fact, they become superior for many uses.

Figure 8:
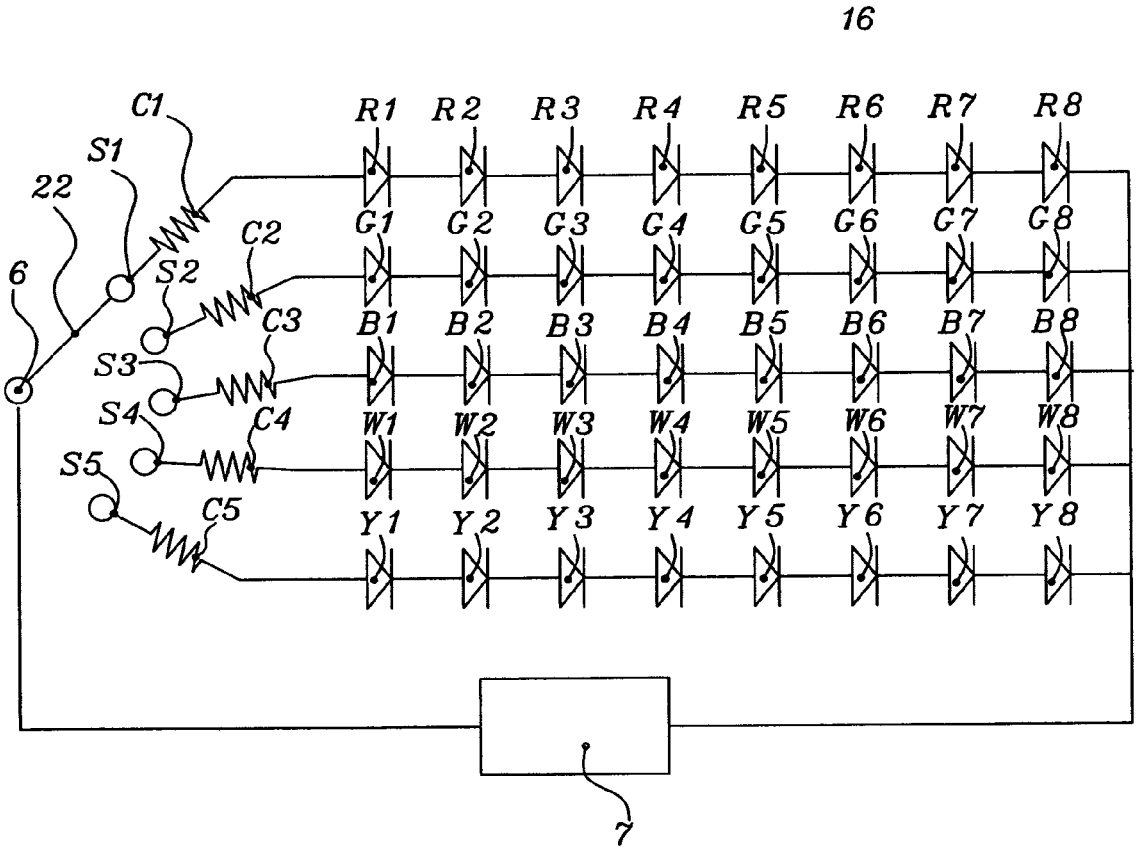

Looking at FIG. 8 schematic 16 of FIG. 8, rotary switch 6 has contact arm 22 connecting power supply 7 to red circuit S1. In this position of switch 6, power supply 7 is in a series circuit relationship with red resistor C1 and red LED lamps R1 through R8. Power supply 7 is a battery of 28 volts DC, however, it could be any one of a variety of sources of electrical power including an external source such as a regulated direct current power supply. Red resistor C1 reduces the voltage from power supply 7 such that when the remaining voltage is divided among red LED lamps R1 thru R8, they are energized to the power level required for lighting device 30 to emit a light beam meeting specification intensity and beam width requirements. Rotary switch 6 is a typical rotary switch in which rotation of a knob 21 rotates contact arm 22 to selectively energize any one of five circuits S1 through S5. By rotating knob 21, a person can rotate contact arm 22 such that power supply 7 forms a series electrical circuit with green circuit S2. In this position of rotary arm 22 power supply 7 is in electrical series with green resistor C2 and green LED lamps G1 through G7. Since lighting device 30 may have specification intensity and beam width requirements which change as the emitted color changes and since the green and red LED lamps may not be equal in efficiency to the red LED lamps, green resistor C2 will probably have a different value then red resistor C1. The different resistor values selected for each circuit represent a dedicated power control used to control the power and select the energy level supplied to the plurality of LED lamps representing each particular color in their series circuit. Using knob 21, an operator can similarly energize any one of the remaining circuits S3, S4 or S5 and therefore, energize the blue, white or infrared LED lamps. Each of these pluralities of LED lamps have their power controlled by dedicated resistors C3, C4 or C5 respectively. The exact power supplied to each plurality of LED lamps of each color is determined by the resistor in the series circuit with lamps of that color. The value of the resistor is usually established by trial and error after the output beam for each color is measured and compared with the specification requirements for that color. There are numerous alternate classical circuit configurations which could substitute for the one shown in schematic 16 of FIG. 8. These include pulse width modulation, constant current, constant voltage, etc. Regardless of the circuit employed, it is desirable that it have a power control means such as resistors C1 through C5 regulating the power supplied to each plurality of color LEDs to assure that each plurality receives its established or fixed energy level selected to meet the specification requirements. Looking at FIGS. 3, 4, 9, 10, 11 and 12 Lens 1 is a converging lens shown having a typical plano convex form 29 to establish focal line 26. However, the current invention is not limited to the plano convex form of a condensing lens as there are numerous alternative classical light converging lens forms which could acceptably be employed in the current invention. In this preferred embodiment when a particular LED is energized, its diverging emitted colored light will be directed radially outward and intersect lens 1 where—due to the converging contour of lens 1—it will be concentrated towards a vertical beam width. Since lens 1 has a horizontal curved focal circle 24 and group 9 LED lamps are disposed having an equiangular location, the light from each plurality of LED lamps will emerge from lens 1 concentrated toward a specification vertical beam width and also throughout an azimuth having a larger angular width. The location and size of the vertical beam width and the azimuth will be determined by the shape of lens 1, the shape of focal line 26 and other parameters. These parameters are developed using classical ray tracing and testing. According to the prior art references, the emerging beam will be elongated. U.S. Pat. No. 6,048,083 issued to McDermott in Col 8 Line 14 refers to the elongated beam. U.S. Pat. No. 5,899,557 issued to McDermott in Col 11 Lines 31-35 refers to a beam with a horizontal beam spread that exceeds a vertical beam spread. Since group 9 LED lamps are disposed in horizontal plane H encircled by lens 1 according to FIG. 3 and prior art, the emerging beam will have a first beam width or beam spread in the vertical plane and a larger beam width in the horizontal plane or azimuth. Therefore, the energizing beam from lighting device 30 will be elongated in a direction parallel to a plane coincident with focal points 25 which in the current embodiment is horizontal plane H.

Looking now at FIG. 11, energized red LED R1 is typical of remaining red LEDs R2 through R8 and also of the remaining LEDs of group 9 when they are energized. Red LED R1 is disposed with its light emitting element 15 at focal point F1 on horizontal plane H so that its emitted light intersects interior surface 27 of lens 1. Red LED R1 emits a variety of diverging light rays. Upper vertical light ray L1 and lower vertical light ray L2 are typical of those emitted in vertical plane V. Light rays L1 and L2 intersect interior surface 27 at a vertical distance D2 which is related to the size and mass of lens 1.

The referenced prior art which provided elongated beam patterns only disclosed lighting devices having a single color and for those devices there was only one curved focal line due to the fact that the light was substantially of one wavelength. Unfortunately the present invention requires a variety of colors and when a variety of colors ranging from ultraviolet to infrared are to pass through the lens, the lens has a different focal point and different related focal line relating to each color. This is basic physics in which different colors have different velocities as they pass through the lens. The different velocities create a different index of refraction for each color resulting in a different focal length for each color. Thus, LED lamps of a first color may be on the focal line for that color and have their emitted light correctly concentrated towards the photometric specification by the surrounding lens. However, LED lamps of a second color, when placed in the identical location on that exact focal line, will not have their light correctly concentrated because the lens (due to the different wavelength of light being refracted) bends the light differently. The lens requires lamps of the second color to be at a different location in order to have their emitted light correctly concentrated. This color related difference in refraction, in addition to other color related variables, can result in a lighting device that is neither efficient nor meets the photometric specification for one or more of the required colors.

The back focal length D1 and focal point F1 in FIG. 11 are correct when using the index of refraction for the red color of red LED R1 during the design of lens 1. However, using classical lens design, if we had used the index of refraction for blue LED B1, then lens 1 with its existing contour would have a focal point at a different location from focal point F1 and a different back focal length in place of back focal length D1. Since the present embodiment of this invention employs five different colors, lens 1 in FIG. 11 would in effect have five different color related focal points—one for each color—typified by focal point F1. There is, therefore, a spacing between any two of these focal points. FIG. 11 is a cross section of lighting device 30 and focal point F1 for red colored red LED R1 relates to focal line 26 and focal circle 24 in the full view of lighting device 30 as shown in FIGS. 3, 4, 9 and 10. In the same way each additional focal point that would appear in FIG. 11 resulting from a different color would have a representative color related focal line and focal circle. Also, the separation distances between the various color related focal points would equal the separation distances between the plurality of color related focal lines and between the plurality of color related focal circles. This focal point spacing is directly proportional to the magnitude of the back focal length. In the current preferred embodiment focal line 26 is only 5 millimeters from interior surface 27. Therefore, back focal length D1 is 5 millimeters and because this dimension is relatively small, the spacing between any two color related focal points is minimized. Prior art, on the other hand, shows all relatively large focal lengths. Arimura in FIG. 4 establishes it at 1 inch. If like prior art, large focal lengths are employed then the spacing between color related focal points would be proportionally larger resulting in a design in which some colors could fail to meet the photometric specification because their emitted light would be misdirected by the lens. Therefore, the use of a small back focal length as disclosed in the present invention reduces the focusing problem created whenever a single converging lens such as converging lens 1 is employed to concentrate light from a variety of colors.

Focal lengths exceeding fifteen millimeters have been found to encourage inefficiencies in some multi-color lighting devices.

Looking again at FIG. 1 with red LED element 15 at focal point F1 on focal line 26 and focal circle 24, lens 1 is concentrating red light as designed. Each of the LEDs of group 9 are, like red LED R1, additionally positioned with their apparent point of emission on apparent emission line 33 which in the present embodiment is coincident with focal circle 24. Apparent emission line 33 does not have to be coincident with focal circle 24. Its location is determined by a number of parameters including the exact variety of colors, the lens contour and the color which was used to determine focal circle 24. For reasons previously described, the focal point of converging lens 1 for green LED G1 is at alternate point 32 spaced at a distance from focal point F1. This is a problem because all of the group 9 LEDs like red LED R1 are positioned on focal circle 24 on apparent emission line 33 which is also circular. Therefore, green LED G1, all remaining green LEDs G2 through G8 and all other colored LEDs are not at their color related focal points. Thus, all other colors of emitted light except red will not be correctly refracted by lens 1. Looking again at FIG. 11 all group 9 LEDs like red LED R1 are positioned with their LED elements on apparent emission line 33. Therefore, typical green LED G1 having the same dimensional relationship to lens 1 as red LED R1 would have its LED element behind its focal point located at alternate point 32. For most required specifications, this would not be desirable. In addition, this would loose the positioning advantages of prior art U.S. Pat. No. 6,048,083 issued to McDermott wherein when employing a single color it was advantageous for some specifications to dispose the apparent point of emission of each LED between its focal point and lens 1. In order to employ the concepts of the prior art design, we can increase the diameter of apparent point of emission line 33 such that it is between alternate point 32 and interior surface 27 of converging lens 1. If this is accomplished, then group 9 LEDs having red or green colors would all have their apparent points of emission between their color related focal points and lens 1.

It is important to realize that there is a difference between the construction—especially in the placement of the LED lamps—of a device that concentrates the light about a plane and maximizes intensity directly in front of each LED and a device that solely maximizes the intensity about a plane. There is an additional difference between a lighting device that maximizes the light directed into a vertical beam spread. The required specification will greatly influence the placement of the LED lamps. The overall performance of the lighting device will depend on a number of parameters which interact to create the efficiency of the emerging beam. In FIG. 11 group 9 LED lamps are disposed with their apparent point of emission line 33 on focal circle 24. This is the most advantageous position if the specification required the light to be concentrated about horizontal plane H with the highest intensity in vertical plane V directly in front of red LED R1. If on the other hand, the specification required the light only to be concentrated with minimal divergence about horizontal plane H then for many configurations of lighting device 30 group 9 LED lamps would be—according to McDermott U.S. Pat. No. 6,048,083—disposed just slightly in front of focal circle 24 between focal circle 24 and lens 1. In this configuration apparent point of emission line 33 would be between focal circle 24 and lens 1. Finally, if the specification required the light to be concentrated within a wider vertical beam spread and throughout a three hundred and sixty degree azimuth, then group 9 LED lamps would be placed a larger distance in front of focal circle 24 between focal circle 24 and lens 1. As previously stated, the shape of the emerging light beam from lighting device 30 depends upon a number of variables in addition to LED placement. Establishing acceptable characteristics for each variable can be achieved with ray tracing and prototyping.

The ceramic LED has parameters which are very helpful in producing the multi-color lighting device as disclosed in this application. The typical ceramic LED shown in FIGS. 6 and 7 as red LED R1 is substantially less popular and more expensive than the T1 or T1 ¾ LEDs disclosed in prior art and drawn in FIG. 15. The ceramic red LED R1 was designed to be surface mounted on a printed circuit board. It comprises a thin rectangular package having a size of 3.5 millimeters×3.5 millimeters×0.8 millimeters. The 0.8 millimeters represent the height from the back of the LED to the LED element. In contrast a typical T1 LED which is similar and smaller than the T1 ¾ discussed in prior art is tubular in shape with a base diameter of 3.9 millimeters and a height from the base to the LED element of about 3 millimeters. Thus, the T1 LED is 0.4 millimeters larger at the base and 2.2 millimeters higher from the base to the LED element. The size and shape of the ceramic LED permits more LEDs to be employed in a printed circuit board of a fixed size employed with a lens having a fixed focal circle. More LEDs in the array generally improve the intensity and azimuthal uniformity of the emerging light beam. The ceramic LED such as red LED R1 does not include the lens of the commonly used T1 LED and this absence of a lens avoids light from one LED being lost due to its intersecting the lens or body of an adjacent LED. The absence of a lens provides an LED in which the apparent point of light emission is coincident with light emitting element 15. Hence, there is no apparent shifting of the point of emission. The problem of apparent shifting of the point of emission was reviewed in FIG. 15. As revealed in prior art, this problem is serious even for the single color employed in prior art. In the current invention, it is exacerbated as the apparent shifting is also color related. For example, in FIG. 15 LED lamp 40 is a typical T1¾ LED lamp and due to lens 44 LED element 43 appeared to originate from apparent point of emission 50. This analysis was based upon one color. If LED lamp 40 is unchanged except for its color, then a new apparent point of emission separated from apparent point of emission 50 would result. Thus, even within a single LED package, the apparent point of emission can change with color. This new variable if added to the present invention makes it more difficult to overcome the problems relating to dark gaps between energized LED lamps. Prior art—even with an apparent shifting of points of emission—could due to its single color mount all LEDs of a similar package on a circular printed circuit board and have a circular apparent emission line. If in place of the ceramic LEDs of the present embodiment LEDs having lenses or domes were employed then these LEDs could not be physically mounted on a circular printed circuit board and still maintain a circular apparent emission line. This apparent emission line would step in or out depending upon the color of each LED. This stepping would cause lens 1 to misdirect light.

The absence of a lens on ceramic LED results in an LED emitting light having a widely divergent pattern in which the total directivity to fifty percent of peak intensity is 120 degrees. This wide divergence also helps fill dark zones between LED lamps in the emerging light beam. In the present embodiment, the ceramic LEDs of group 9 have an equiangular disposition and are attached to peripheral edge 20 of printed circuit board 5 with their emitted light directed radially outward from center point 31 to intersect lens 1.

When mounted on peripheral edge 20 the LEDs do not use surface space on printed circuit board 5. This space is commonly needed for other components or conductive tracks 8 and saving space permits a lighting device of a reduced size. Finally, by attaching ceramic red LED R1 to peripheral edge 20 and soldering it to peripheral top 19 and possibly peripheral bottom 18, the heat generated by red LED R1 is readily transferred away from LED element 15 by conduction at solder pads 13 and 14, by conduction into peripheral edge 20 of printed circuit board 5 and by convection as air moves freely past ceramic body 14. The other ceramic LEDs of group 9 representing a variety of colors employed in the preferred embodiment are similarly mounted having good heat dissipation. Thus, all of the intrinsic advantages of the surface mounted ceramic LED are realized even though it is mounted not as designed on the face of a printed circuit board but on a peripheral edge directing its emitted light radially outward to accommodate the directivity needs of the preferred embodiment.

FIGS. 16 and 17 disclose converging lens 53 which can be substituted for converging lens 1 of FIG. 1. Depending upon the required photometric specification, the light spreading elements 54 can have a variety of contours. Since they are shown as vertical elements perpendicular to horizontal plane H which in the present embodiment is coincident with focal points 25 and focal line 26, they will spread the light in a direction parallel to a plane coincident with focal line 26 and horizontal plane H. In so doing, they reduce the unwanted dark zones in the emitted light beam caused by dark gaps between light emitting LED lamps of different colors. Light spreading elements 54 can be added to either interior surface 27, curved exterior surface 28 or both. Classical optical ray tracing as well as experimentation can establish the location and contour of light spreading elements 54 that are required to comply with a particular photometric specification.

As previously discussed, prior art was designing to have their LEDs in close contact and near the center of the lens. Looking at FIGS. 3-5 with switch 6 energizing red circuit S1 as shown in FIG. 8, only red LED lamps R1 through R8 are energized. All of the remaining lamps of group 9 representing colors other than red are dark. Therefore, there is a large dark gap between energized lamps. This undesirable dark gap is not as shown in prior art and intuitively not a good design if the objective is to minimize azimuthal variations in intensity. Dark gaps between energized lamps will tend to create dark zones in the output beam. This problem persists for each color selected by switch 6. Prior art positions its LED lamps so there is minimal gap between LED lamps and in so doing, avoids this problem. It has been found by experimentation in the present invention that regardless of the fact that dark gaps between energized LEDs are problematic, many specification requirements including efficiency, photometric, size, etc can still be achieved using the concepts of the present invention. Concepts including: a curved cylindrical converging lens, a small focal length, LED lamps emitting divergent light, small powerful ceramic LED lamps peripherally mounted, positioning the LED lamps with their apparent point of emission between a plurality of color related focal lines and the lens, and light spreading elements on the lens, each contribute towards compliance with a particular photometric specification.

Although the description above contains many specificities, these should not be construed as limiting the scope of the invention but as merely providing illustrations of some of the presently preferred embodiments of this invention.

For example, in FIG. 9 interior surface 27 is a straight line. However, other acceptable light converging lenses may have a curved interior surface when in the vertical cross section of FIG. 9. In this case, the back focal length would still be defined as the distance between focal point F1 and the interior surface.

Also, it is to be understood that within the current application, the term color includes: the many colors of the visible spectrum, ultraviolet, white and infrared light. Also, light emitted from two different light sources is to be considered as having different colors if that light appears to the normal eye as having different colors.

Also, in the preferred embodiment, lens 1 has a plano convex form 29 and in FIG. 9 is shown as having back focal length D1, focal point F1 and a focal line 26 which is a focal circle 24. Focal point F1 is classically defined as the point in hollow 11 of FIG. 11 at which incident horizontal parallel rays from the exterior of lens 1 in vertical plane V converge. Each additional cross section similar to FIG. 11 in a different vertical plane will disclose an additional focal point similar to focal point F1. Focal line 26 is the locus of these focal points. Focal line 26 is a focal circle 24 in the preferred embodiment because lighting device 30 is designed to concentrate the light into a light beam having a required vertical beam spread throughout an azimuth of three hundred sixty degrees. There are specifications which only require the emerging light beam to extend throughout a limited azimuth such as one hundred eighty degrees. For these specifications, focal line 26 would not form a circle. It would have a reduced azimuth related to the required azimuth of the specification.

Also, the use of the term LED lamp within the present application is not meant to be restricted to the LED lamp disclosed in the preferred embodiment. Any lamp comprising an LED element which meets the needs of the controlling specification can be employed. Finally, the present invention was created by fabricating and testing a variety of multi-color lighting devices.

Thus the scope of the invention should be determined by the appended claims and their legal equivalents, rather than by the examples given.

I claim:

1. A lighting device comprising:

a converging lens for concentrating light, said converging lens having a curved contour, a hollow and a plurality of focal points on a curved line;

a group of LED lamps each positioned within said hollow about said curved line to direct emitted light radially outward to intersect said converging lens, said group comprising a variety of colors each having a plurality of LED lamps; and a circuit comprising said group of LED lamps and a switch for selectively energizing each said plurality of LED lamps through connection to a power supply, each said plurality of LED lamps upon connection to said power supply emitting a light concentrated by said converging lens and forming an elongated light beam.

2. A lighting device comprising:

a converging lens for concentrating light, said converging lens having a curved contour, a hollow and a plurality of focal points on a curved line;

a group of LED lamps each positioned within said hollow about said curved line to direct emitted light radially outward to intersect said converging lens, said group of LED lamps comprising a variety of colors each having a plurality of LED lamps; and a circuit comprising said group of LED lamps and a switch for selectively energizing each said plurality of LED lamps through connection to a power supply, each said plurality of LED lamps upon connection to said power supply emitting a light concentrated by said converging lens toward a plane comprising said curved line.

3. A lighting device comprising:

a converging lens for concentrating light, said converging lens having a curved contour, a hollow and a plurality of focal points on a curved line, said plurality of focal points each disposed within fifteen millimeters of said converging lens;

a group of LED lamps each positioned within said hollow about said curved line to direct emitted light radially outward to intersect said converging lens, said group of LED lamps comprising a variety of colors each having a plurality of LED lamps; and a circuit comprising said group of LED lamps and a switch for selectively energizing each said plurality of LED lamps through connection to a power supply, each said plurality of LED lamps upon connection to said power supply emitting a light concentrated by said converging lens.

4. A lighting device comprising:

a converging lens for concentrating light, said converging lens having a curved contour, a hollow and a plurality of focal points on a curved line;

a group of LED lamps each positioned within said hollow substantially about said curved line to direct emitted light radially outward to intersect said converging lens, said group of LED lamps comprising a variety of colors each having a plurality of LED lamps;

said group of LED lamps each having an apparent point of emission and a substantially coincident LED element; and a circuit comprising said group of LED lamps and a switch for selectively energizing each said plurality of LED lamps through connection to a power supply, each said plurality of LED lamps upon connection to said power supply emitting a light concentrated by said converging lens.

5. A lighting device comprising:

a converging lens for concentrating light of a variety of colors, said converging lens having a curved contour and a hollow, said converging lens having a plurality of color related focal points disposed on a plurality of color related curved focal lines;

a group of LED lamps comprising said variety of colors each having a plurality of LED lamps, said group of LED lamps each having an apparent point of emission disposed within said hollow between said plurality of color related focal lines and said converging lens, said group of LED lamps each disposed to direct emitted light radially outward to intersect said converging lens; and a circuit comprising said group of LED lamps and a switch for selectively energizing each said plurality of LED lamps through connection to a power supply, each said plurality of LED lamps upon connection to said power supply emitting a light concentrated by said converging lens.

6. A lighting device comprising:

a converging lens for concentrating light, said converging lens having a curved contour, a hollow and a plurality of focal points on a curved line;

a group of LED lamps each positioned within said hollow about said curved line to direct emitted light radially outward to intersect said converging lens, said group comprising a variety of colors each having a plurality of LED lamps; and a circuit comprising said group of LED lamps and a switch for selectively energizing each said plurality of LED lamps through connection to a power supply;

a printed circuit board connected to said converging lens, said group of LED lamps each having a ceramic body soldered to said printed circuit board and disposed on a peripheral edge of said printed circuit board, each of said plurality of LED lamps upon connection to said power supply emitting a light concentrated by said converging lens.

7. A lighting device according to claim 1, 2, 3, 4, 5 or 6 wherein;

said plurality of LED lamps are disposed having an equiangular spacing.

8. A lighting device according to claim 1, 2, 3, 4, 5 or 6 wherein;

said converging lens comprises a common portion concentrating said light of at least two of said variety of colors.

9. A lighting device according to claim 1, 2, 3, 4, 5 or 6 wherein;

said light from each said plurality of LED lamps is concentrated toward a horizontal plane.

10. A lighting device according to claim 1, 2, 3, 4, 5 or 6 wherein;

said group of LED lamps are disposed in a radial array about a center point of said converging lens.

11. A lighting device according to claim 1, 2, 3, 4, 5 or 6 wherein;

said converging lens further comprises a plano convex cross section.

12. A lighting device according to claim 1, 2, 3, 4, 5 or 6 wherein;

said converging lens is a cylindrical fresnel lens.

13. A lighting device according to claim 1, 2, 3, 4, 5 or 6 wherein;

said converging lens further comprises light spreading elements.

14. A lighting device according to claim 1, 2, 3, 4, 5 or 6 wherein;

said circuit further comprises a series circuit for each said plurality of LED lamps, each said series circuit includes a dedicated power control having an established energy level.

15. A lighting device according to claim 1, 2, 3, 4, 5 or 6 wherein;

said circuit further includes a power control having an established energy level dedicated to each said plurality of LED lamps.

16. A lighting device according to claim 1, 2, 3, 4, 5 or 6 wherein;

said variety of colors includes at least four colors.

17. A lighting device according to claim 1, 2, 3, 4, 5 or 6 wherein;

said variety of colors includes at least five colors.

18. A lighting device according to claim 1, 2, 3, 4, 5 or 6 wherein;

said variety of colors comprises white and infrared.

19. A lighting device according to claim 1, 2, 3, 4, 5 or 6 wherein;

said variety of colors comprises red, green, blue, white and infrared.

20. A lighting device according to claim 1, 2, 3, 4, 5 or 6 wherein;

said variety of colors comprises red, green and blue.

21. A lighting device according to claim 1, 2, 3, 4 or 6 wherein;

said curved line is substantially circular.

22. A lighting device according to claim 1, 2, 3, 4 or 6 wherein;

said converging lens has an exterior curved cylindrical surface comprising light spreading elements disposed to spread said light from each said group of LED lamps parallel to a plane coincident with said plurality of focal points.

23. A lighting device according to claim 1, 2, 3, 4 or 6 wherein;

said plurality of focal points are coincident with a horizontal plane; and said light from each said plurality of LED lamps is further concentrated into a light beam having a specification vertical beam width throughout a three hundred and sixty degree azimuth.

24. A lighting device according to claim 1, 2, 3, 4 or 6 wherein;

said plurality of focal points are coincident with a horizontal plane; and said light from each said plurality of LED lamps is further concentrated into a light having a specification vertical beam width of at least four degrees throughout a three hundred and sixty degree azimuth.

25. A lighting device according to claim 1, 2, 3, 4 or 6 wherein;

said plurality of focal points are coincident with a horizontal plane; and said light from each said plurality of LED lamps is further concentrated into a light having a specification vertical beam spread of at least thirteen degrees throughout a three hundred and sixty degree azimuth.

26. A lighting device according to claim 1, 2, 3, 4 or 6 wherein;

said plurality of focal points are coincident with a horizontal plane; and said light from said plurality of LED lamps is further concentrated into a light having a specification vertical beam spread of at least ten degrees throughout a three hundred and sixty degree azimuth.

27. A lighting device according to claim 2, 3, 4, 5 or 6 wherein;

said light from aid plurality of LED lamps is further concentrated by said converging lens into an elongated light beam.

28. A lighting device according to claim 2, 3, 4 or 6 wherein;

said light from each said plurality of LED lamps is further concentrated by said converging lens into a light beam elongated in a direction parallel to a plane coincident with said plurality of focal points.

29. A lighting device according to claim 1, 2, 3 or 6 wherein;

said group of LED lamps each have an apparent point of emission disposed approximately on said curved line.

30. A lighting device according to claim 1, 2, 3 or 6 wherein;

said group of LED lamps each have an apparent point of emission disposed between said curved line and said lens.

31. A lighting device according to claim 1, 2, 4 or 6 wherein;

said converging lens includes an interior surface disposed less than fifteen millimeters from said curved line.

32. A lighting device according to claim 1, 2, 3 or 6 wherein;

said group of LED lamps each have an apparent point of emission disposed on a circular apparent emission line.

33. A lighting device according to claim 1, 2, 3, 4 or 5 wherein;

said group of LED lamps each have a ceramic body.

34. A lighting device according to claim 1, 2, 3, 4 or 5 wherein;

said group of LED lamps each have a ceramic body disposed on a peripheral edge of a printed circuit board connected to said converging lens.

* * * * *